United States Patent [19]

Anderson

[11] Patent Number: 4,945,637

[45] Date of Patent: Aug. 7, 1990

[54] POWER-DRIVEN CHAIN SAW

[75] Inventor: Harvey G. Anderson, Muskegon, Mich.

[73] Assignee: Pro Power Corporation, Kalamazoo, Mich.

[21] Appl. No.: 294,765

[22] Filed: Jan. 6, 1989

[51] Int. Cl.[5] ..... B27B 17/02

[52] U.S. Cl. ..... 30/122; 30/123.4; 30/383; 30/500

[58] Field of Search ..... 30/122, 381–387, 30/500, 123.4

[56] References Cited

U.S. PATENT DOCUMENTS

| | | | |
|---|---|---|---|
| 4,272,889 | 6/1981 | Scott et al. | 30/122 X |
| 4,819,335 | 4/1989 | Alexander | 30/122 X |
| 4,821,415 | 4/1989 | Kress | 30/122 |
| 4,858,318 | 8/1989 | Anderson | 30/383 X |

*Primary Examiner*—Frank T. Yost

*Assistant Examiner*—Rinaldi Rada

*Attorney, Agent, or Firm*—Gordon W. Hueschen

[57] ABSTRACT

There is disclosed a power-driven chain saw converted from a stripped-down power-driven circular power hand saw which has a unitary housing adapted to be mounted on the power unit of the stripped-down power-driven hand saw. The housing is offset axially to provide a relatively wide area on one side having a window therein through which sawdust is deflected. Support-bar mount is an integral part of the housing as are a sawdust deflector, an oil reservoir, and a support-bar mounting boss. A sprocket is splined to a hub from which it is easily removable and which, in turn, is splined to the drive shaft with a more firm splining. A cover is provided for the housing which closely conforms to the chain and has an axially disposed dent or impression therein to accommodate the hub of the sprocket.

10 Claims, 2 Drawing Sheets

POWER-DRIVEN CHAIN SAW

FIELD OF THE INVENTION AND THE PRIOR ART

This invention relates to a power-driven chain saw converted from a power-driven circular hand saw and to a replacement housing therefor.

Various conversion chain saws obtained by converting a circular power hand saw are known in the art. For example, in U.S. Pat. No. 2,839,097, a chain-saw support-bar mounting block is affixed to the power unit of a circular power hand saw and a chain-saw drive sprocket is mounted on the power drive shaft instead of the circular saw to drive a chain-saw chain around the support bar. The support bar is clamped onto the mounting block by a tension-adjusting clamp block. The chain-saw attachment of this patent is to that kind of chain saw, which will be referred to as a pin-and-groove type because the chain is guided around the support bar by a pin or tongue riding in a peripheral groove in the support bar.

Similar conversion chain saws are disclosed in U.S. Pat. Nos. 4,270,270, 4,272,889, and 4,033,035.

Another type, to be referred to herein as a saddle-type chain saw, is disclosed in U.S. Pat. No. 4,309,931. In this type, the chain links have bearing faces which ride on the peripheral edge of the support bar and side members or flanges which center the chain on the support bar. A special sprocket, referred to herein as a saddle-type chain sprocket, is used. This kind of sprocket and a saddle-type chain conceivably can be substituted in U.S. Pat. No. 2,839,097, but efforts to make such substitutions have not been satisfactory heretofore.

OBJECTS OF THE INVENTION

It is object of the invention to overcome the disadvantages of the prior art. Another object is to provide new and effective chain saws converted from a power-driven circular hand saw. It is a further object to provide a unitary replacement housing for converting a power-driven circular hand saw to a power-driven chain saw. It is yet a further object to provide a new, useful, and unobvious chain saw. These and further objects will become apparent as the description proceeds.

SUMMARY OF THE INVENTION

This invention relates to a power-driven chain saw converted from a power-driven circular hand saw which comprises:

a stripped-down power unit of a power-driven circular hand saw having a mounting face on one side with a drive shaft projecting normally therefrom;

a chain-saw sprocket on said drive shaft;

a replacement housing member affixed to said mounting face for enclosing said sprocket and a chain-saw chain mounted thereon;

a chain-saw chain support bar affixed to said housing in functional alinement with said sprocket;

said housing member having a base member having a bottom, one face of which is complementary to and adapted to be mounted on said mounting face with said drive shaft projecting normally therethrough;

parallel side members parallel to said drive shaft and having an open end through which said chain and said support bar project;

an arcuate closed-end member spanning said side members;

a cover plate adapted to conform to and to be removably fastened to said parallel side members and said arcuate closed-end member; and one of said parallel side members and a portion of said arcuate member being close to said support bar and spaced therefrom to provide a relatively close clearance from said chain, and the other of said parallel side members and the remainder of said arcuate portion being spaced farther from said chain support to leave a substantial area between said chain and said other parallel side member.

The invention also relates to one or more further features in which said substantial area has a window therein provided with deflecting means for deflecting sawdust to the exterior of said housing; in which said window comprises a substantially rectangular opening extending from adjacent said chain saw support bar to adjacent said other parallel side; in which said deflecting means comprises a flange projecting inwardly and upwardly from the lower edge of said opening toward said cover; in which said flange has a relatively low portion extending under said chain saw chain and a relatively high portion extending from adjacent said chain saw chain to said other side member and out to adjacent said cover member; which further comprises an oil delivery means comprising an oil reservoir, one side wall of which comprises one of said parallel side members, the opposite side wall of which is substantially parallel to said one side wall, the back wall of which is an integral extension of said base member, and the front wall of which lies substantially in the plane of said cover member; in which said base member has a mounting boss member provided with fastening means for fastening said support bar thereon in alinement with said sprocket; in which said mounting boss member has tension-adjusting means therein for adjusting the position of the support bar on said base member; in which said tension-adjusting means comprises a longitudinal slot having therein an elongate screw having threaded thereon a follower having outwardly-projecting means adapted to engage said support bar, said follower being adapted to be moved longitudinally when said screw is turned thereby imparting a longitudinal movement to said support bar; in which said mounting boss has an elongate longitudinal boss adapted to fit into a complementary slot in said support bar to prevent angular movement of said support bar, said slot having a length relative to said elongate boss sufficient to admit of the longitudinal adjustment needed to adjust the tension of the chain-saw chain; in which said mounting boss has a longitudinal channel therein in communication with said oil delivery means and adapted to register with an opening in said support bar in communication with said chain when it is mounted on said support bar, said channel being essentially the same length as said longitudinal slot, whereby oil is delivered to said chain whatever the position of said support bar on said mounting boss; in which said sprocket is releasably mounted for rotation with said drive shaft by axial spline means such that it can readily be removed axially; in which said sprocket is held against substantial axial movement on said shaft by said cover member; and in which said sprocket has a hub member which projects beyond said support bar with a chain thereon and in which said cover member has a dent or impression complementary to said hub, whereby the dented portion is juxtaposed to said hub and the undented portion is juxtaposed to said support bar with said chain thereon.

The invention also relates to a replacement housing as described above for converting a power-driven circular hand saw into a chain saw.

DESCRIPTION OF PREFERRED EMBODIMENTS

Figure 1:
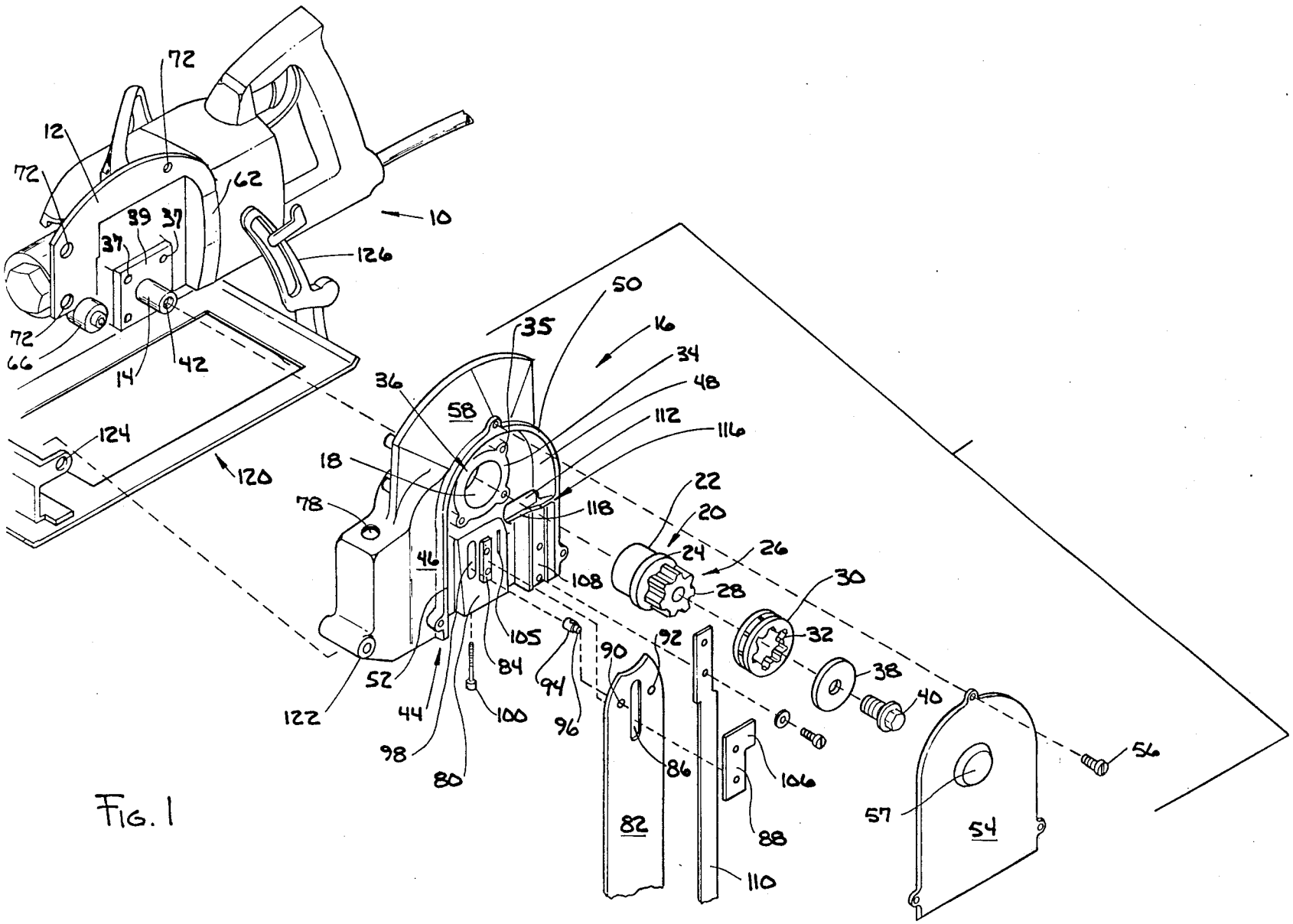
FIG. 1 is an exploded view of a chain saw of the invention.
Figure 4:
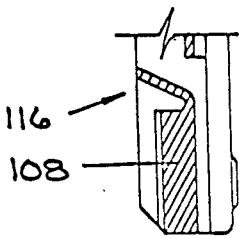
FIG. 4 is a section on line 4—4 of FIG. 2.
Figure 3:
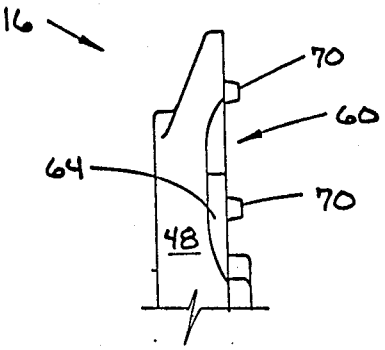
FIG. 3 is a side view of FIG. 2 looking in the direction of the arrow.

In FIG. 1, 10 is a stripped-down power unit of a circular power hand saw which has been stripped of its circular blade and the protective housing thereof leaving a housing mounting face 12 and a driven shaft 14 projecting normally therefrom. A replacement housing 16 having a bore 18 in axial alinement with driven shaft 14 is mounted on the housing mounting face 12 with the driven shaft 14 projecting axially into bore 18 but not through it.

In alinement with the driven shaft 14 is a connecting shaft 20 having a cylindrical drum-like portion 22, a flange portion 24, and a rough-splined portion 26 having teeth 28 like a pinion gear. A chain-saw sprocket 30 is provided with internal splines or teeth 32 complementary with the splines or teeth 28 of the rough-splined portion so that the sprocket 30 can be slipped on and off of the rough-splined portion 26 as desired. The connecting shaft 20 is adapted to be slipped into the bore 18 and secured to the driven shaft 14 by splining, keying, bolting, or other means. The dimensions are such that the drum-like portion 22 fits snugly in the bore 18 and forms therewith a bearing. The flange portion 24 fits snuggly against the front face 34 which forms the outer annular portion 36 of the bearing. This portion has peripherally-disposed apertures 35 for bolting the housing to corresponding threaded apertures 37 in the face plate 39.

All the portions of the replacement housing 16, unless otherwise specified, are cast or otherwise formed as a unitary integral structure. If desired, however, frictionless bearing surfaces (not shown) can be interposed between the bore 18 and the drum-like portion 22, for example, roller bearing races, oilless bronze sleeves, or the like, or that portion of the replacement housing can be substituted by a separate standard machine bearing.

In the embodiment of FIG. 1, the connecting shaft 20 and the sprocket 30 are secured together to rotate as a unit with the driven shaft 14 by means of washer 38 and bolt 40 adapted to be threaded into an internally threaded axial bore 42 in the end of driven shaft 14. Alternatively, the shaft 14 can be splined or keyed into an axial bore in the drum-like portion 22.

The replacement housing 16 has an upstanding flange 44, parallel sides 46 and 48, a convex semicircular top 50 and an open bottom. It is to be understood that top, bottom and like terms of orientation apply to the drawings because the device itself, being portable, can be positioned in an infinite number of different orientations. The front faces 52 of the sides and top of the flange 44 all lie in a common plane which is normal to the axis of the drive shaft 14. A complementary cover plate 54 is adapted to be bolted to, or otherwise fastened to, flange 44 by a number of bolts, or the like, one of which is illustrated at 56. This cover plate has on its inner face an axially-disposed impression or indentation 57 conforming with the end of the sprocket assembly which allows the major portion of the cover to be closely opposed to the circulating chain.

The upper portion of the replacement housing 16 comprises an upstanding plate 58 conforming to the upper portion of the housing mounting face 12 and the rear face 60 is shaped to conform to the shape of the stripped down power unit 10. Thus, where the power unit bulges out as shown at 62, there is provided a complementary depression 64 in the replacement housing 16 and, where a cylindrical artifact 66 projects from the power unit 10, it fits snugly in a complementary cylindrical depression, as shown at 68. The rear face 60 has protuberances 70 which are shaped to fit the bolt holes 72 in the housing mounting face 12 and which are internally threaded (not shown) so that the replacement housing 16 can be firmly and rigidly affixed to the stripped-down power unit 10.

The replacement housing 16 has an integrally-formed oil reservoir 74 which has upper and lower openings 76–78 which are artifacts of the casting process. One, usually the bottom one 76, is plugged and the other is threaded to receive an oil pump (not shown).

Figure 2:
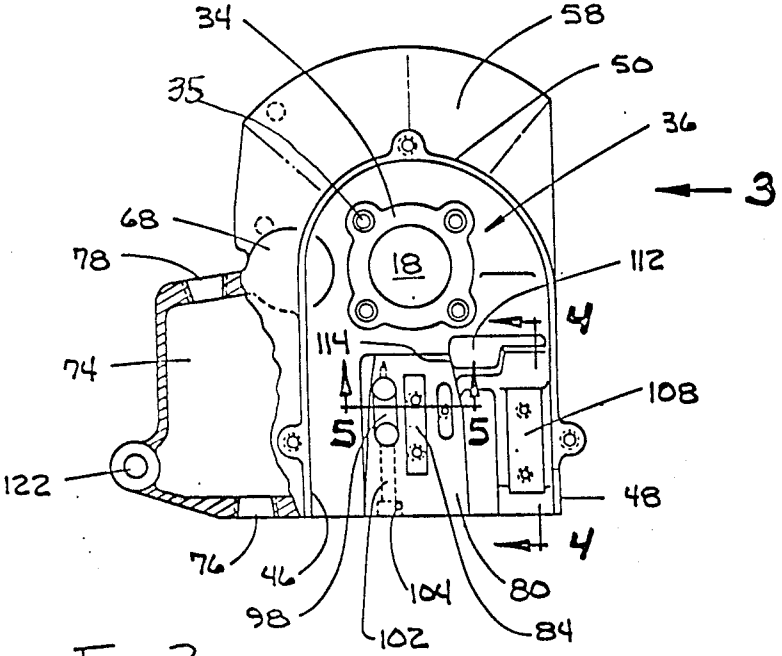
FIG. 2 is a face view of the replacement housing as shown in FIG. 1.
Figure 5:
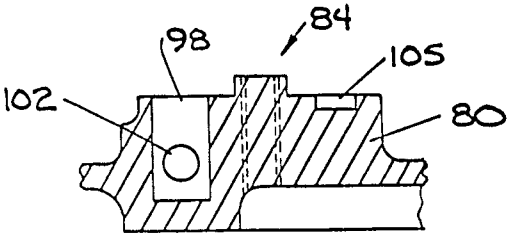
FIG. 5 is a section on line 5—5 of FIG. 2.

The inner face of the replacement housing 16 is provided with a mounting boss or raised platform 80, as shown in FIGS. 1, 2, and 5, which is adapted for mounting thereon a chain-saw support bar 82. The boss 80 has a elongate, vertical boss 84 complementary to the mounting slot 86 in the support bar 82 and has a height essentially equal to, advantageously a little less than, the thickness of the support bar 82 so that, when the support-bar 82 is affixed on the mounting boss 80 with the elongate boss 84 seated in the mounting slot 86, a clamping plate 88 can be bolted thereon to hold the support bar 82 firmly and rigidly on the mounting boss 80. The height of the mounting boss 80 is such that the support bar 82 is in alinement with the sprocket 26 so that a chain saw chain can be mounted thereon and driven by the sprocket 26. The support bar 82 can be provided with a peripheral groove (not shown) to guide the chain saw blade and keep it on the support bar 82, but other means for accomplishing these ends can be used. The length of the slot 86 is such that the position of the support bar 82 on the mounting boss 80 can be vertically moved up or down as needed to adjust the tension on the chain saw chain.

The support bar 82 has two holes or apertures 90 and 92 therethrough, one on each side of the elongate slot 86. These holes can be artifacts in the manufacture of the support bar. The apertures 90 and 92 can be utilized as described below.

In order to effect adjustment of the tension on the chain when it is on the support bar 82, a traveler 94 having a protuberance 96 adapted to fit into aperture 90 is mounted in an elongate channel 98 on an elongate screw 100 which, in turn, is mounted in a vertical bore 102 extending from the bottom of the mounting boss 80 up through the channel 98. The screw 100 is held against vertical movement by a pin (not shown) driven in a bore 104 provided therefor. Thus, when the screw is turned one way the traveler 94 is moved up and, when it is turned in the opposite direction, the traveler 94 is moved down and the corresponding movement is imparted to the support bar 82 by the protuberance 96.

The mounting boss 80 has an elongate, vertical oil groove 105 into which oil is adapted to be pumped through a suitable conduit (not shown) and the support bar 82 has a transverse bore (not shown) which extends from the right periphery of the support bar 82 to the aperture 92 which is alined with oil groove 105 so that oil can be conducted to a chain riding on the support bar 82. The aperture 92 need not go all the way through the support bar 82, only up to communication with the transverse bore but, if it does, the clamping plate 88 can be provided with an extension 106 which covers aperature 92.

At or adjacent the inside of the flange 48, there is provided a guard mounting boss 108 on which can be bolted a chain guard 110. This guard mounting boss is positioned to hold the guard 110 along and adjacent the non-cutting edge of the chain.

It is to be noted that the space between the flange 46 and the mounting boss 80 is only as wide as needed for the chain to circulate around the support bar 82, whereas the space between the flange 48 and the mounting boss 80 is considerably wider. This provides ample room for the guard mounting block 108 and for means for keeping the sawdust from being circulated into and accumulating in the housing 16. For this purpose there is provided a transverse window 112 extending from side 48 to adjacent the mounting boss 80. If desired the upper corner of the mounting boss can be cut back as shown at 114 in order to make the window 112 longer. At the bottom edge of window 112 there is provided a deflecting flange 116 which extends upwardly and outwardly to a position adjacent the cover 54 except for the portion 118 which is in the path of the circulating chain.

If desired, foot plate or shoe 120 can be mounted on the bottom of the replacement housing similar to or identical with the foot plate of the original circular power saw. It can be hinged to the replacement housing 16 by hinge elements 122 and 124 and can have an angle adjustment 126 at the opposite end.

There is thus provided a chain saw which has been converted from a circular power saw which can be readily mounted or taken down and which provides for safe and effective operation. There is provided such a saw in which the sprocket and the upper portions of the chain are completely enclosed in a replacement housing and in which means is provided for minimizing the tendency for sawdust to accumulate in an enclosed housing.

While the invention has been described with reference to particular embodiments thereof, it is to be understood that it is not to be limited in the details of these embodiments as variations will readily be apparent to those skilled in the art once they have been apprised of the invention and that the invention, accordingly, is not to be limited except by the scope of the appended claims.

I claim:

1. A power-driven chain saw converted from a power-driven hand saw which comprises:

a stripped-down power unit of a power-driven circular hand saw having a mounting face on one side with a drive shaft projecting normally therefrom;

a chain-saw sprocket on said drive shaft;

a housing member for enclosing said sprocket and the chain-saw chain thereon;

said housing member having a base member normal to said drive shaft and having side members thereon parallel to said drive shaft and an open end through which a substantial portion of said chain and said support bar project and an arcuate closed end arcing around said shaft;

a cover plate adapted to conform to and to be removably fastened to said parallel side members and said arcuate closed-end member; and one of said parallel side members and a portion of said arcuate member being close to said support bar and spaced therefrom to provide a relatively close clearance from said chain and the other of said parallel side members and the remainder of said arcuate portion being spaced farther from said chain support to leave a substantial area between said chain and said other parallel side member, in which said substantial area has a window therein comprising a substantially elongate opening extending lengthwise from adjacent said chain saw support bar to adjacent said other parallel side, said window being provided with deflecting means for deflecting sawdust to the exterior of said housing, said deflecting means comprising a flange projecting inwardly and upwardly from the lower edge of said housing toward said cover plate.

2. A chain saw according to claim 1 in which said window comprises a substantially rectangular opening

3. A chain saw according to claim 1 in which said flange has a relatively low portion extending under said chain saw chain and a relatively high portion extending from adjacent said chain saw chain to said other side member and out to adjacent said cover member.

4. A chain saw according to claim 1 which further comprises an oil delivery means comprising an oil reservoir, one side wall of which comprises one parallel side member, the opposite side wall of which is substantially parallel to said one side wall, the back wall of which is an integral extension of said base member, and the front wall of which is substantially parallel to said back wall and lies substantially in the plane of said cover member.

5. A chain saw according to claim 1 in which said sprocket is held against substantial axial movement on said shaft by said cover plate.

6. A chain saw according to claim 5 in which said sprocket has a hub member which projects beyond said support bar with a chain thereon and in which said cover plate has a dent or impression complementary to said hub, whereby the dented portion is juxtaposed to said hub and the undented portion is juxtaposed to said support bar with said chain thereon.

7. A replacement housing for converting a power-driven circular hand saw into a chain saw comprising:

a base member adapted to be mounted on a power unit with the drive shaft thereof projecting normally therethrough;

parallel side members normal to said base member having an open end through which a chain and support bar can project;

an arcuate closed-end member spanning said side members;

a cover plate adapted to conform to and to be removably fastened to said parallel side members and said arcuate closed-end member; and one of said parallel side members and a portion of said arcuate member being close to said chain support and spaced therefrom to provide a relatively close clearance from said chain and the other of said parallel side members and the remainder of said arcuate portion being spaced from said chain support to leave a substantial area between said chain and said other parallel side member;

in which said substantial area has a window therein comprising a substantially elongate opening extending lengthwise from adjacent said chain saw support bar to adjacent said other parallel side, wherein said window is provided with deflecting means for deflecting sawdust to the exterior of said housing, said deflecting means comprising a flange projecting inwardly and upwardly from the lower edge of said opening toward said cover.

8. A replacement hosing according to claim 7 in which said window comprises a substantially rectangular opening.

9. A replacement housing according to claim 8 in which said flange has a relatively low portion in the path to be traversed by a chain saw chain and a relatively high portion extending from adjacent said chain saw chain to said other side member and out to adjacent said cover member.

10. A replacement housing according to claim 7 having a mounting boss member in which said mounting boss has a longitudinal channel therein in communication with an oil delivery means and adapted to register with an opening in said support bar in communication with said chain when it is mounted on said support bar.

* * * * *